US007371131B2

(12) United States Patent
Houtz

(10) Patent No.: US 7,371,131 B2
(45) Date of Patent: May 13, 2008

(54) CONNECTOR HAVING RETENTIVE RIB

(75) Inventor: Timothy W. Houtz, Etters, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/098,048

(22) Filed: Apr. 4, 2005

(65) Prior Publication Data

US 2006/0223349 A1 Oct. 5, 2006

(51) Int. Cl.
*H01R 13/42* (2006.01)

(52) U.S. Cl. ..... 439/751

(58) Field of Classification Search ..... 439/100, 439/751, 680, 752.5, 74, 733.1, 83, 931, 439/876, 70, 78, 875, 342, 362, 701, 607–610, 439/686, 752; 29/843, 884
See application file for complete search history.

(56) References Cited

U.S. PATENT DOCUMENTS 3,923,365 A * 12/1975 Lynch ..... 439/751
4,374,604 A * 2/1983 Hemmer et al. ..... 439/587
4,878,861 A * 11/1989 Kendall et al. ..... 439/751
5,135,414 A 8/1992 van Dijk ..... 439/692
5,730,606 A * 3/1998 Sinclair ..... 439/70
5,921,788 A 7/1999 Wilson et al. ..... 439/78
6,079,991 A 6/2000 Lemke et al. ..... 439/83
6,093,035 A 7/2000 Lemke et al. ..... 439/83
6,328,577 B1 * 12/2001 Azuma ..... 439/83
6,350,143 B2 * 2/2002 Kato et al. ..... 439/374
6,382,989 B1 * 5/2002 Yu ..... 439/83
6,425,785 B1 * 7/2002 Azuma ..... 439/733.1
6,843,662 B2 * 1/2005 Ju ..... 439/83

* cited by examiner

*Primary Examiner*—Edwin A. Leon
(74) *Attorney, Agent, or Firm*—Woodcock Washburn LLP

(57) ABSTRACT

A connector includes conductive pins inserted into apertures in a housing. The pins may include a single groove or a pair of opposing grooves in which ribs of the housing are disposed. The ribs may conform to the shape of the grooves to retain the pins in the housing apertures. The apertures may includes an extended side opening that opens onto an upper surface of the housing to enable a contact beam and shielding bar to be inserted from the top. Solder balls may be disposed on an underside of the connector.

39 Claims, 7 Drawing Sheets

CONNECTOR HAVING RETENTIVE RIB

FIELD OF THE INVENTION

This invention relates to electrical or electronic connectors, and more particularly to connectors having an array of pins secured to a housing.

BACKGROUND OF THE INVENTION

Connectors having a two-dimensional array of conductive pins in an insulative housing often include solder balls disposed on an underside of the housing. The solder balls are connected to or disposed on ends of the pins to enable electrical connection to a printed wiring board.

Often, pins are held in place in the array by press fitting them into openings in the connector housing. A planar shield is often disposed between rows of pins to inhibit crosstalk and like drawbacks. Shields are especially useful in tightly packed or high speed connectors but may be employed in other circumstances. In some arrays of pins, such as pins retained by press fitting, residual stresses can build up such that stress and/or strain is transmitted from one portion of the housing (proximate a pin) to an adjacent portion. In this way, stresses can build up or accumulate, which diminish the planarity of the contacts and/or solder balls or having other drawbacks.

SUMMARY OF THE INVENTION

A connector is provided that comprises a housing having plural apertures in which plural pins are disposed. At least one of the pins includes a longitudinal groove formed therein and at least one of the apertures includes a gap at least partly defined by a rib. The rib in an as-molded state has a cross-sectional profile that is different from a cross-sectional profile of the corresponding longitudinal groove. Accordingly, upon insertion of the pin into said aperture the profile of the rib conforms to match at least a portion of the groove profile.

The aperture may have a pair of opposing ribs that are disposed in and contact a pair of opposing grooves in each pin. Alternatively, the aperture may have a single rib that is disposed in and contacts a groove in the pin; opposite the single rib, the housing may be flat or have another shape that does not constitute a rib. Preferably, the gap has a dimension less than a width of the pin measured at the groove or between the pair of grooves, wherein the apex of the rib deforms against the bottom of the groove so as to form an interference fit. The conformation of the rib to the groove diminishes stress transmitted to parts of the housing adjacent to the rib and diminishes strain in parts of the housing adjacent the rib.

The pins may have a contact portion extending upwardly from the housing and a solder ball is disposed in a depression on the underside of the housing, and is coupled to the pin opposite the contact portion. The pins may include at least one embossment formed in the groove for enhancing engagement between the pin and the corresponding rib. Also, the rib may include at least one embossment formed thereon for enhancing engagement between the rib and the corresponding pin.

The aperture preferably includes an elongate portion extending approximately perpendicular to a centerline of the corresponding ribs or perpendicular to a plane defined by the centerlines of corresponding ribs. A contact beam is disposed the aperture elongate portion and contact a corresponding pin. Preferably, a shield is disposed along a row of pins, the shield being coupled to the contact beam.

Also provided is a ball grid array connector that includes an array of pins, a housing, an array of solder balls, and a plurality of contact beams. The pins, which are disposed in a corresponding array of apertures in the housing, include opposing longitudinal grooves.

The housing has an upper side, an underside, and the array of apertures. At least a portion of the apertures include an elongate portion that opens onto the upper side of the housing. The apertures include a gap at least partly defined by a pair of opposing ribs, which are conformable in response to insertion of the pin into the aperture to secure the pin. The solder balls disposed on the housing underside proximate ends of said pins. The contact beams disposed are at least partly in the elongate portions of the apertures such that the contact beams are insertable into the aperture from the upper side of the housing.

The ribs in an as-molded state preferably have a cross-sectional profile different from a cross-sectional profile of the corresponding pin groove such that upon insertion of the pin into said pin aperture the profile of the ribs conforms to match at least a portion of groove profile. Preferably, the ribs engage the pins in interference fits. The connector may also include a slot that opens onto an upper surface of the housing and a shielding bar disposed in the slot. The shielding bar is in contact with at least a portion of said contact beams.

DETAILED DESCRIPTION OF ILLUSTRATIVE EMBODIMENTS

Figure 1:
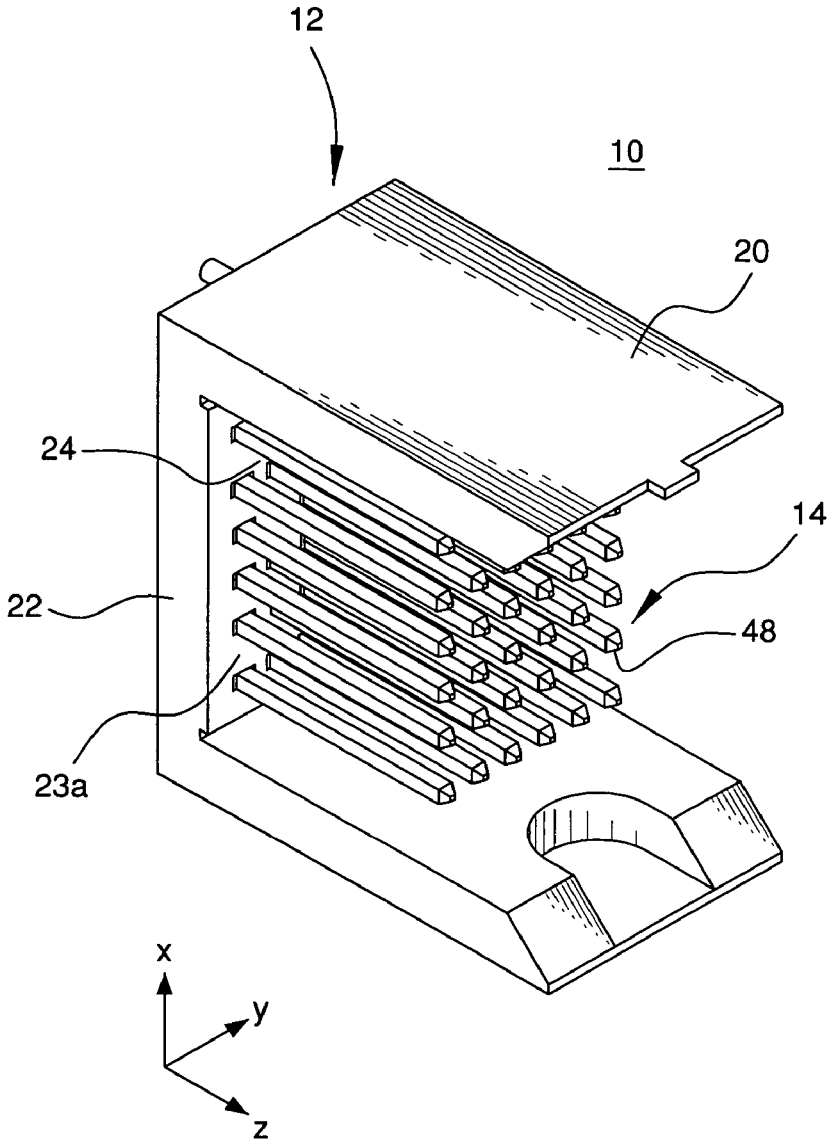
FIG. 1 is a perspective view of a connector according to an embodiment of the present invention.
Figure 2:
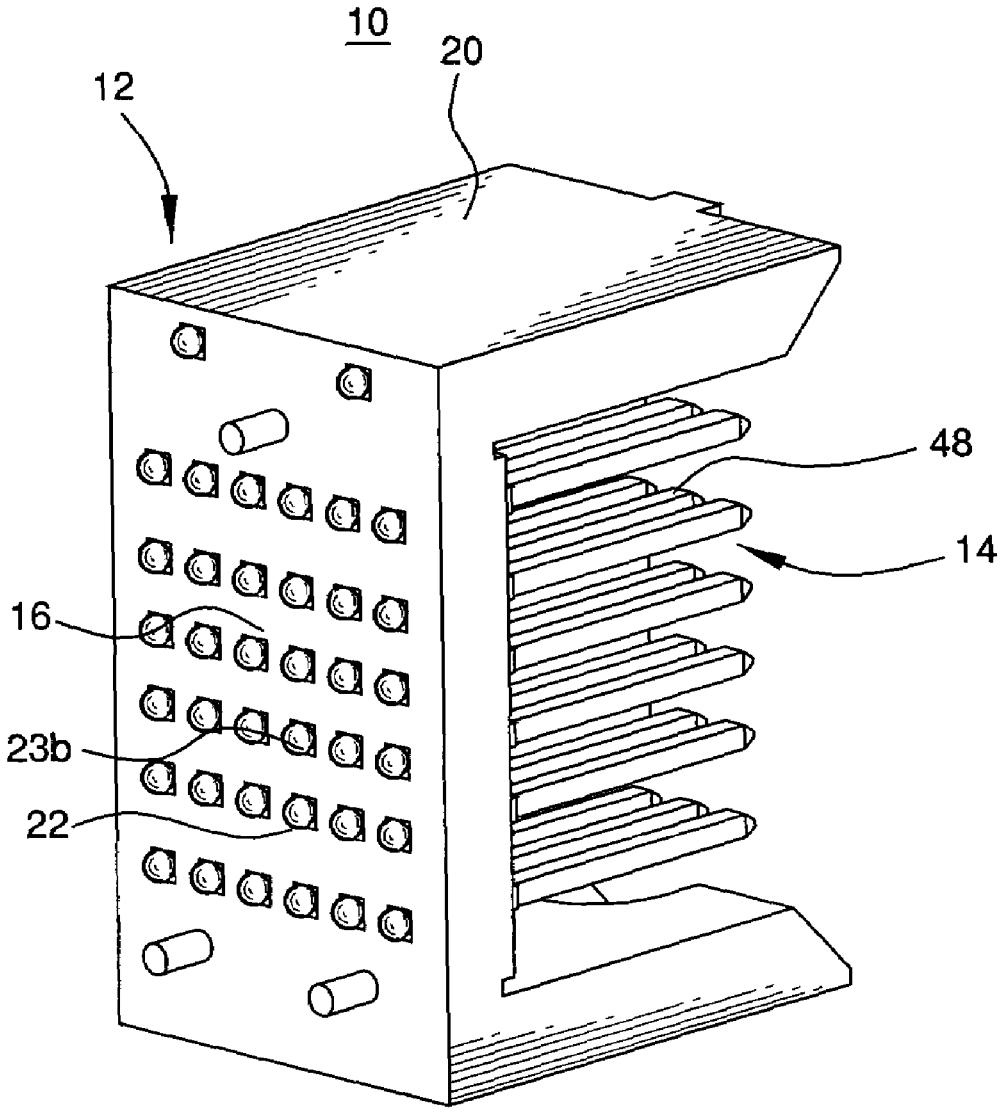
FIG. 2 is another perspective view of the connector of claim 1.

Referring to the figures to illustrate an embodiment of the present invention, a ball grid array connector 10 includes an insulative housing 12, plural pins 14 retained in or by housing 12, and solder balls 16. Housing 12 preferably includes a pair of opposing sidewalls 20 connected by a base 22 that has an upper surface or upper side 23*a* and an opposing lower side or underside 23*b*. A coordinate system is shown on some figures to aid in the understanding of the orientation of the parts.

Figure 7:
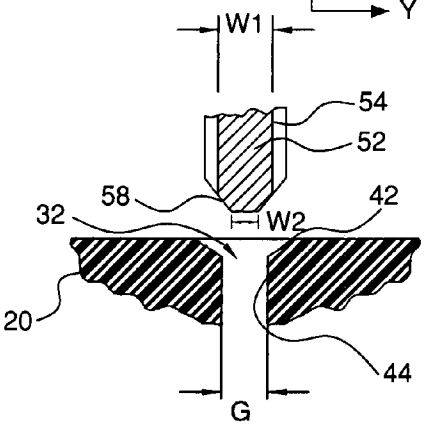
FIG. 7 is an enlarged, sectional view of a portion of the connector shown in FIG. I taken approximately through the lines 7-7 shown in FIG. 6 with the pin near the position for insertion into the aperture of the connector.
Figure 8:
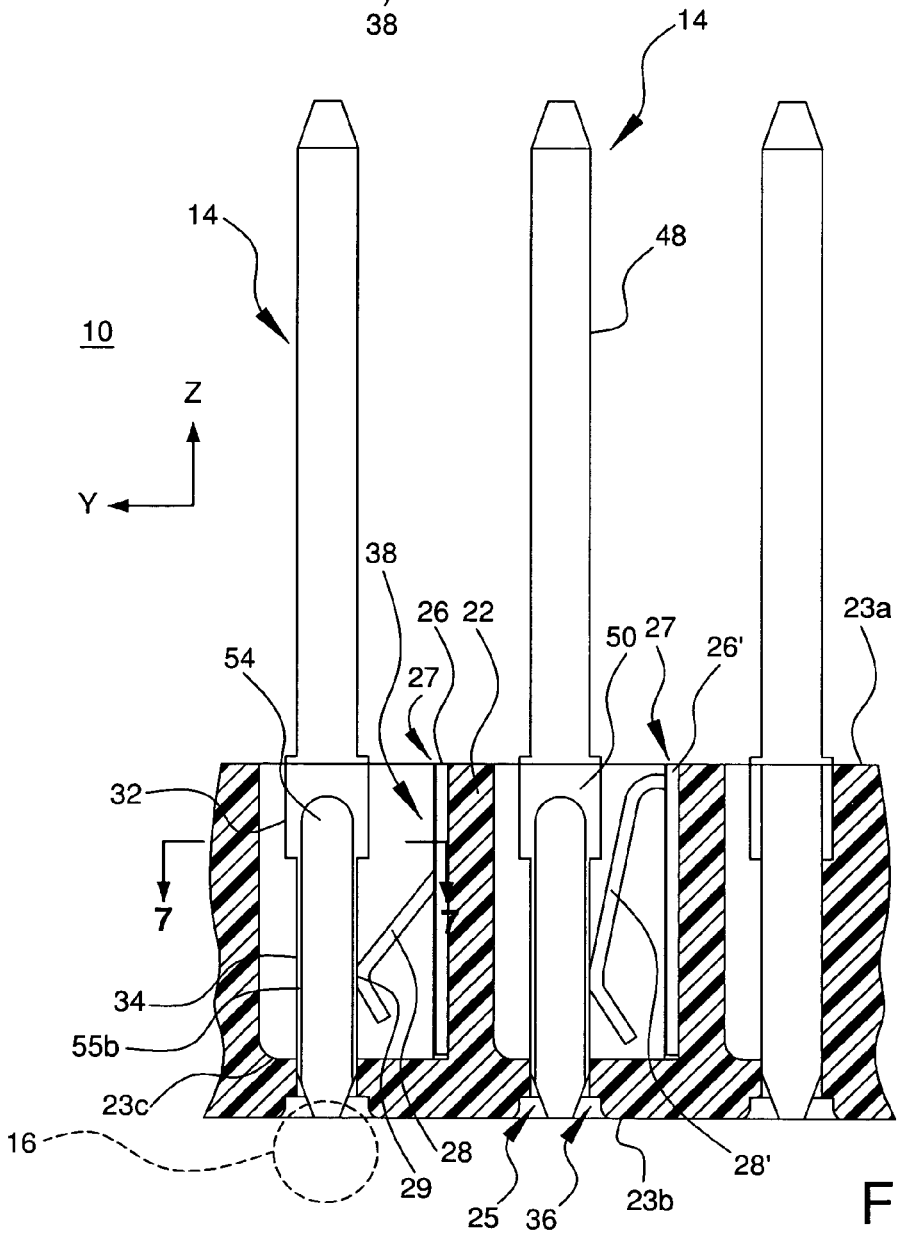
FIG. 8 is an enlarged, sectional view of a portion of the connector shown in FIG. 1.

Housing 12 includes arrays of apertures 24 from upper side 23*a* to lower side 23*b*. Pins 14 are disposed parallel to the z-axis in apertures 24 such that a pin is disposed in each aperture in a one-to-one relationship. As best shown in FIG. 8, which is a sectional, elevational view of the x-y plane taken at the face of pins 14, apertures 23 include an upper portion 32 and a medial portion 34 disposed below upper portion 32. Medial portion 34 opens into a bottom-facing ball socket 36. Accordingly, aperture 24 preferably extends from housing upper side 23*a* through base 22 to open onto underside 23*b*. As best shown in FIGS. 3, 4, 7, and 9, aperture 24 includes an enlarged or extended side opening 38 that, preferably, opens onto housing upper side 23*a*.

An elongate shielding bar 26 is disposed in an elongate recess 27 formed in the upper surface 23*a* of housing 12. Preferably, shielding bar 26 is planar to provide shielding between adjacent rows of pins 14. A contact beam 28 is coupled to shielding bar 26 and disposed at least partly in the extended portion 38. Shielding bar 26 and contact beam 28 may be formed from a unitary piece of a conductive sheet such the contact beam is bent so as to extend from shielding bar 26.

Preferably, contact beam 28 extends outwardly from shielding bar 26 at an oblique angle and includes a distal bent to form a bent our rounded contact surface 29 that contacts pin 14, as more fully explained below. As recess 27 and aperture extended portion 38 open upwardly onto housing upper surface 23*a*, in the illustrated embodiment disclosed in the figures, shield 26 and contact beam 28 can be inserted from the upper side of housing 12, opposite the solder balls 16.

A contact beam 28 may be employed at each of pins 14 that serve as a power or ground contact. Often, for convenience, power contacts and/or ground contacts are arranged in one or more rows. Accordingly, some shielding bars may be equipped with contact beams at each pin 14 of a row of power or contact pins and other shielding bars may be without contact beams to diminish cross-talk and like drawbacks along rows of signal pins. FIG. 8 shows contact beam 28 and an alternative embodiment contact beam 28'.

Figure 3:
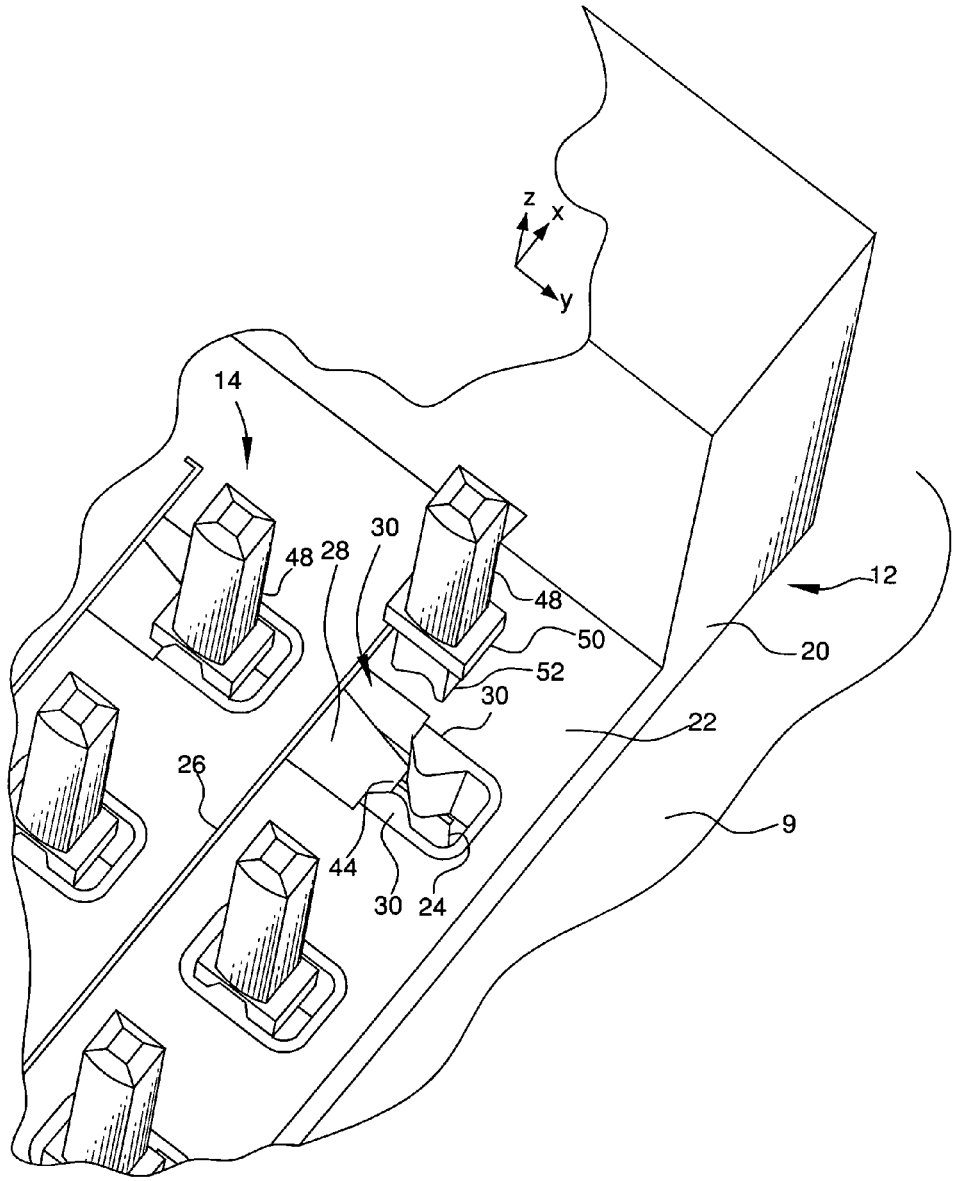
FIG. 3 is an enlarged, partially exploded view of a portion of the connector shown in FIG. 1.
Figure 4:
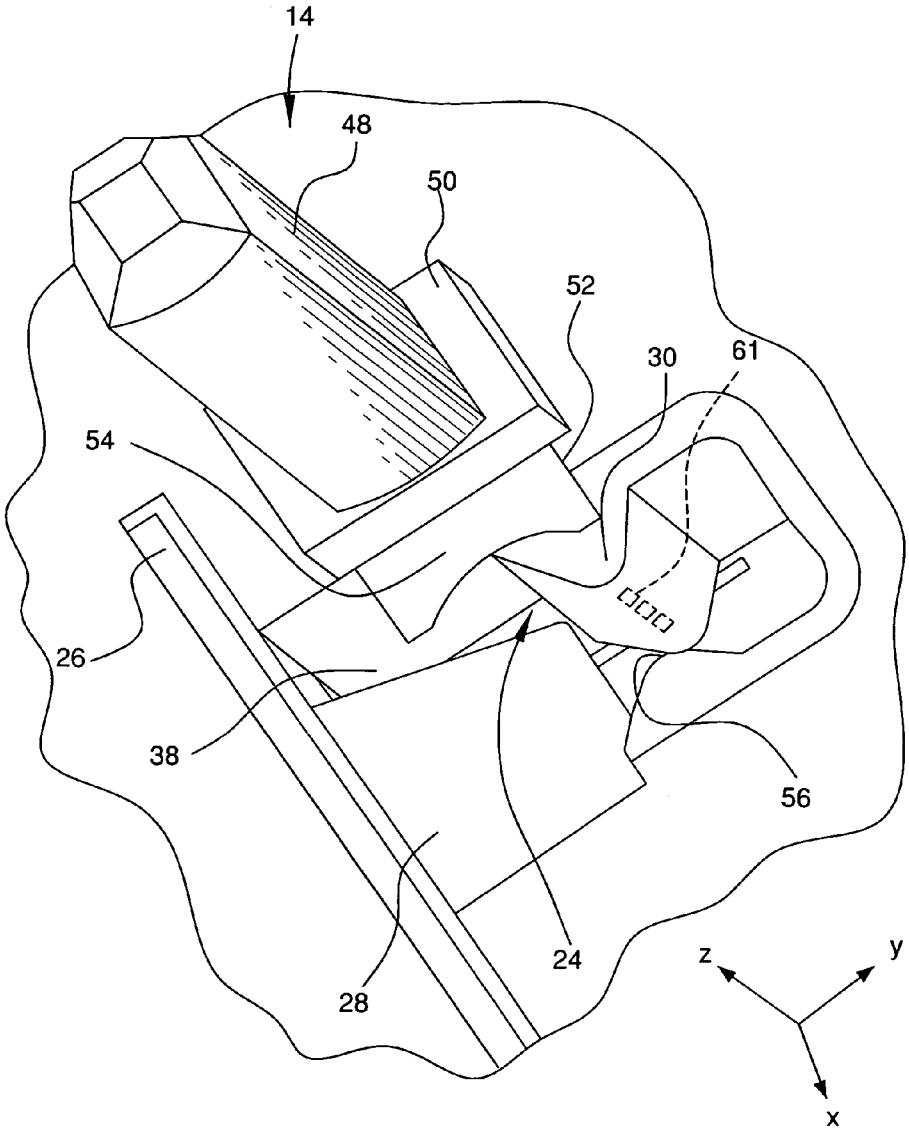
FIG. 4 is an enlarged, partially exploded view of a portion of the connector shown in FIG. 3.
Figure 6:
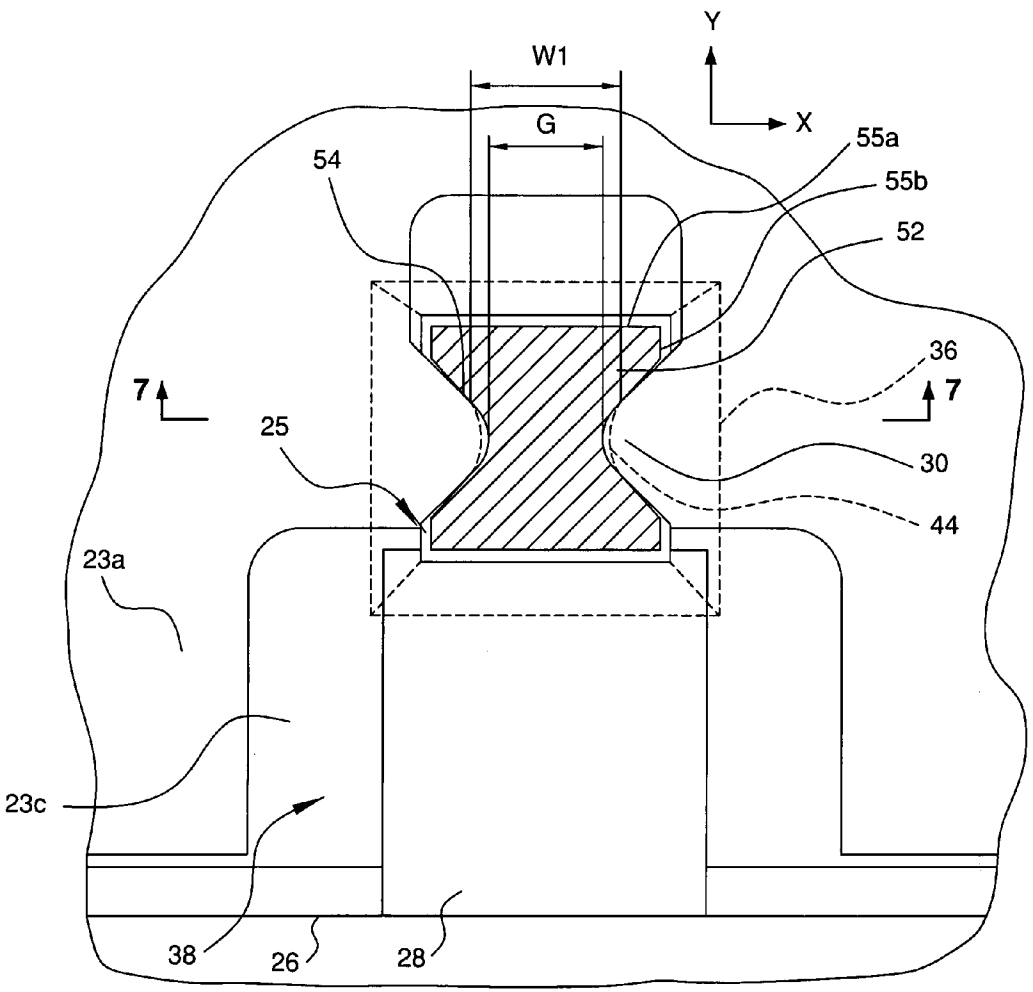
FIG. 6 is an enlarged, sectional view of a portion on the connector shown in FIG. I with a portion of the pin schematically shown disposed in the aperture of the connector.
Figure 9:
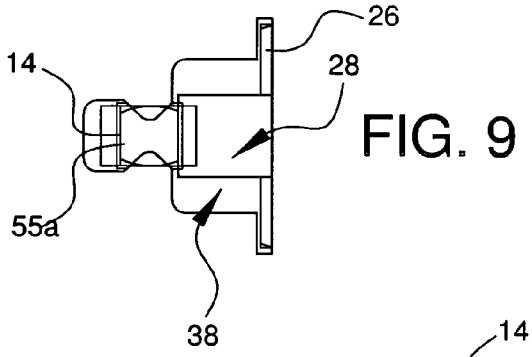
FIG. 9 is a top or plan view of a portion of the connector shown in FIG. 8 such that it is taken perpendicular to the view of FIG. 8.

As shown in FIGS. 3, 4, and 6 a pair of opposing ribs 30 of the housing 12 project into aperture 24. Preferably, ribs 30 are disposed in (or mostly in) aperture upper portion 32. Ribs 30, in plan view or in a transverse cross-sectional view, preferably have a curved shape and terminate at a tip 44. As best shown in FIG. 7, which is a partial cross-sectional view taken through the center of grooves 54 of pin 14 and shows a cross section of housing 12 in the area of rib tips 44, ribs 30 each include a lead-in portion 42 that creates a ramp-like surface extending downwardly from housing upper face 23*a* toward aperture 24. The space between ribs 30, and especially between rib tips 44, forms a gap G (FIG. 7). Preferably, gap G has a uniform dimension in elevational cross-section, as shown in FIG. 7. Accordingly, dimension G is taken along a direction parallel to the x axis.

Pin 14 includes a contact portion 48, a base 50, and a stake portion 52, which preferably are integrally formed. Each pin 14 includes a pair of longitudinal grooves 54 formed on opposing sides of pin 14. Preferably, grooves 54 are formed in stake portion 52 and/or a portion of base 50. The present invention, however, is not limited to the extent or length of grooves 54 shown in the figures and the present invention encompasses grooves extending the length of the pin (not shown in the figures) or along any portion thereof. Preferably, grooves 54 extend substantially to or nearly to a terminal end of pin 14. Pin 14 includes a pair of ungrooved sides 55*a* adjacent to sides 55*b* having grooves 54.

Figure 5:
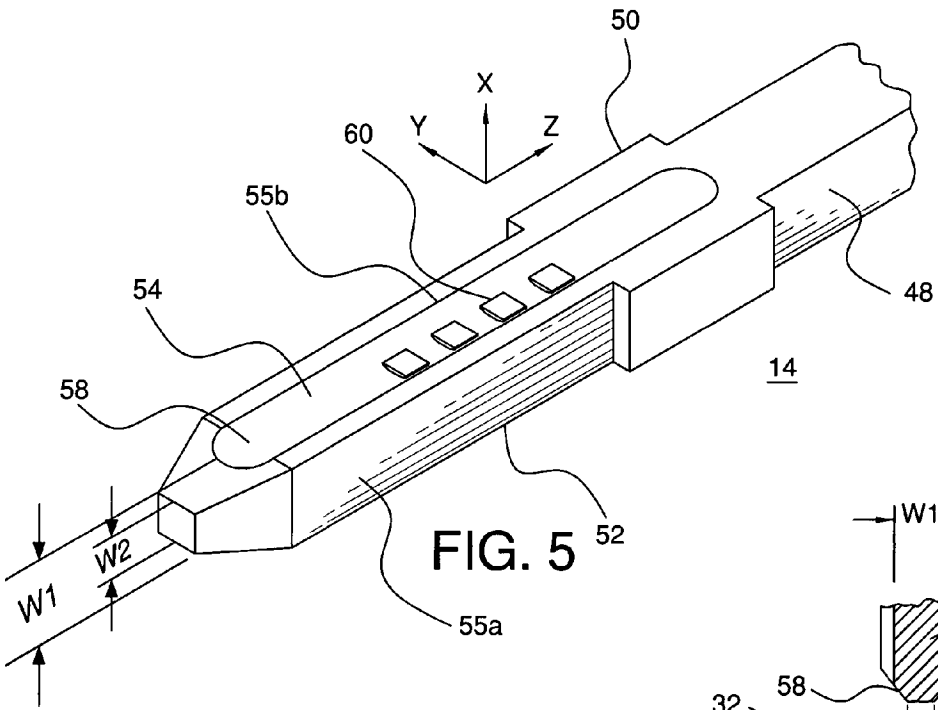
FIG. 5 is an enlarged, perspective view of a pin component of the connector shown in FIG. 1.

Pin 14 preferably includes one or more embossments or protrusions 60 formed in the grooves 54, or none at all. FIG. 5 shows the protrusions 60 formed as rectangular structures extending from the bottom of groove 54. Embossments or protrusions 61 may also or alternatively be disposed on rib tips 44 as shown schematically in dashed lines in FIG. 4. The present invention is not limited to any particular structure, quantity, or location of protrusions 60 and/or protrusions 61.

A width W1 of pin 14 is measured between the bottom dead centers of the main portions of the grooves such that W1 is measured parallel to the x direction. As shown in FIGS. 5 and 7, pin 14 includes a tip 56 that is beveled or tapered to reduce its dimension. Grooved side 55*b* is beveled such that grooves 54 smoothly merge into tip 56 to form a lead-in portion 58. Accordingly, the width W2 of pin 14 at its tip 56 is smaller than its full width W1. Pin tip width W2 preferably is smaller than gap G to aid in centering and initially inserting pin 14 into aperture 24.

Ungrooved side 55*a* may also be tapered at tip 56. The figures show pin stake portion 54 as un-tapered except for the portion near tip 56. But the present invention encompasses pins having a tapered section and other changes to its cross sectional shape and/or size along its length.

FIG. 6 is a view of pin 14 and rib 30 taken above housing upper surface 23*a* and through pin 14 but omitting pin contact portion 48 and base 50 to better illustrate the relationship between groove 54 and rib 30. Housing upper surface 23*a*, shielding bar 26, contact beam 28, extended opening portion 38, and a cross-section of pin 14 are clearly shown in FIG. 6. Ball pocket 36 is shown in phantom to indicate that it is disposed on the underside surface 23*b*. A portion of aperture 24 forms a cavity or hollow that is partly defined by an upwardly facing surface 23*c*. In this regard, the cavity floor 23*c* may be considered to define the lower boundary of aperture medial portion 34.

In this regard, the portion between cavity floor 23*c* and ball pocket 36 may be considered to constitute an aperture lower portion, which is un-numbered in the figures. A through aperture or narrow gap 25 preferably exists between pin stake portion 52 and each of the innermost edges of cavity floor 23*c*, aperture lower portion, and the innermost edges of ball pocket 36 all the way around pin stake portion 52. Alternatively, aperture lowermost portion could contact pin stake portion 52 to enhance rigidity of pin 14 in housing 12.

During insertion of pin 14 into aperture 24 after pin tapered tip 56 and rib lead-in portions 42 have helped to locate pin grooves 54 relative to ribs 30, pin 14 is pressed downwardly into aperture 24. In some circumstances, pin 14 could be inserted into aperture 24 while eliminating or diminishing burrs created from the rib material by the metallic pin 14. Rib 30 extends into groove 54. The transverse cross-sectional shape of rib 30 does not match the transverse cross sectional shape of groove 54. FIG. 6 shows rib 30 in its as-molded state before deformation that may occur upon insertion. In this regard, FIG. 6 is diagrammatic.

The surface of rib 30 at its base is slightly more narrow than the corresponding dimension of groove 54. Gap G between rib tips 44 is less than pin width W1 between the grooves. FIG. 6 shows rib 30 in its as-molded state as a solid line at rib tip 44 and shows the portion of groove 54 near its bottom dead center in a dashed line. Preferably, rib 30 deforms in the region of its tip 44 to conform to the shape of groove 54, and pin 14 is retained by the interference fit and conformance of ribs 30 into grooves 54. Protrusions 60 (and/or protrusions 61) may be used, which protrusions are intended to enhance the retention of pin 14 in housing 12 in the z-direction.

The precise dimensions of groove 54, ribs 30, and like structure will depend upon the materials chosen, the desired overall dimension of pin contact portion 48, the desired mechanical properties such as insertion force, resistance to deflection in the x-y plane, and like parameters. Generally, pin 14 may be formed of any conventional, conductive material commonly employed for such pins and may be formed by an technique, including conventional techniques such as swaging and/or coining.

Housing 12 may be formed of a conventional liquid crystal polymer or like engineering plastic generally suitable for embodiments employing solder balls 16 and for use with reflow temperatures. The hardness, yield point, modulus of elasticity and like properties of the material of housing 12 may particularly take into account the desired interference between ribs 30 and grooves 54 and the corresponding magnitude of the conformance. Based on the material and structure of pin 14, it is expected that pin 14 would like be relatively inflexible. Preferably, in order to provide adequate stability of pin 14 in the x-y plane, the portion of rib tip 44 in groove 54 is expected to be roughly in the range of 0.060 to 0.080 inches (that is, in the z-direction).

Upon assembly, contact portion 48 extends upwardly from housing base 22. Housing 12 may be affixed to a printed wiring board 9 (FIG. 3) such that solder balls 16 are coupled thereto in a reflow process. The ability to insert shielding bars 26 and contact beams 28 from above may, in some circumstances, eliminate the need for insertion molding or like processes, and thereby may simplify the manufacturing process. The overall height of the base 22 of housing 12 may also be made small while securely holding pins 14 by ribs 30 on the sides (that is, grooved side 55*a*) and while enabling ungrooved side 55*b* to be open for access by contact beam 28.

The conformance of ribs 30 within grooves 54 diminishes the compressive stress that would be transmitted to adjacent cells or areas of the housing. Because of the conformance of the ribs, stresses to not accumulate throughout a row or array of pins. In this regard, the structure and/or function disclosed herein isolates the stress and strain caused by the press fit or interference fit of pins 14 locally near the particular pin or, as the term is sometimes used, within a cell.

The phrases "upper," "lower," and "bottom" and the like are used herein merely to provide relative orientation to aid in the explanation of the illustrative embodiment and are not intended to limit the scope of the embodiment of the invention to any particular orientation. Further, the present invention is not limited to any particular configuration. For example, the term pin encompasses not only the single, linear contact shown herein, but also encompasses the corresponding female contact, forked receptacles, and the like. The pins are described as having groove 54 disposed in stake portion 52, and the present invention encompasses any configuration, including for example opposing grooves formed throughout the length of the pin, which in some circumstances may foster manufacturing simplicity. The housing may be formed with a pair of extended side openings formed on opposing sides of pin 14. Similarly, the present invention is not limited to the particular type of connector shown herein; for example, the present invention encompasses male and female connectors, those with and those without solder balls, and connectors regardless of their purpose, as of course limited by the language of the claims. And the present invention is not limited to solving any particular problem; for example, the background section discusses stress build-up among rows or an array of pins, yet the present invention is not limited to structure or circumstances in which stress build-up occurs. According to the foregoing, the claims should be read to define the scope of the present invention.

What is claimed is:

1. A connector comprising:

a housing having plural apertures in which plural pins are disposed, the apertures defining aperture axes that are parallel to the direction of insertion of the pins;

at least one of the pins including a longitudinal groove formed therein that is parallel to its aperture axis;

at least one of the apertures including a gap at least partly defined by a rib, the rib in an as-molded state having a cross-sectional profile different from a cross-sectional profile of the corresponding longitudinal groove, wherein upon insertion of the pin into its corresponding aperture the transverse cross sectional profile of the rib changes to conform to at least a portion of the groove's transverse cross sectional profile.

2. The connector of claim 1 wherein the gap has a dimension less than a width of the pin measured at said groove, wherein the apex of the rib deforms against the bottom of the groove.

3. The connector of claim 1 wherein said at least one pin includes at least one embossment formed in the groove for enhancing engagement between the pin and the conesponding rib.

4. The connector of claim 1 wherein the rib includes at least one embossment formed thereon for enhancing engagement between the rib and the corresponding pin.

5. The connector of claim 1 wherein the rib conformation diminishes stress transmitted to parts of the housing adjacent thereto.

6. The connector of claim 1 wherein the rib conformation diminishes strain in parts of the housing adjacent the rib.

7. The connector of claim 1 wherein the groove is formed on an exterior side of the pin.

8. The connector of claim 1 wherein the rib is formed of a material comprising a plastic.

9. The connector of claim 1 wherein the housing and rib are integrally formed.

10. The connector of claim 1 wherein the groove profile is curved in transverse cross section, and the rib engages the pin in an interference fit.

11. The connector of claim 10 wherein the rib profile is curved and the rib tip engages the pin groove in an interference fit.

12. The connector of claim 1 wherein said at least one pin has a contact portion extending upwardly from the housing and a solder ball is coupled to the pin opposite the contact portion.

13. The connector of claim 12 wherein the housing includes a depression in which the solder ball is disposed on an underside of the housing.

14. The connector of claim 1 wherein at least a portion of said aperture includes an elongate portion extending approximately perpendicular to a centerline of the corresponding rib.

15. The connector of claim 14 further comprising at least one contact beam disposed at least partly in said aperture elongate portion, said contact beam being in contact with a conesponding pin.

16. The connector of claim 15 further comprising at least one shield disposed along a row of pins, the shield being coupled to the contact beam.

17. The connector of claim 16 wherein the housing includes a pocket disposed on an upper side thereof, said shield being at least partly disposed in said housing.

18. The connector of claim 1 wherein each one of the plural pins has a contact portion extending upwardly from the housing and a solder ball coupled thereto to the pin opposite the contact portion.

19. The connector of claim 18 wherein the housing includes plural depression in which the solder balls are disposed on an underside of the housing.

20. The connector of claim 1 wherein said longitudinal groove constitutes a first groove and said rib constitutes a first rib, said at least one pin further including a second longitudinal groove opposite the first groove and the aperture including the gap at least partly defined by the first fib and an opposing second rib, the second fib in an as-molded state having a cross-sectional profile different from a cross-sectional profile of the conesponding second pin groove, wherein upon insertion of the pin into said aperture the profile of the second conforms to match at least a portion of the second groove profile.

21. The connector of claim 20 wherein each one of the pins includes embossments formed in the grooves for enhancing engagement between the pin and the corresponding fibs.

22. The connector of claim 20 wherein each rib includes embossments formed thereon for enhancing engagement between ribs and the corresponding pins.

23. The connector of claim 20 wherein the fib conformation diminishes stress transmitted to parts of the housing adjacent thereto.

24. The connector of claim 20 wherein the rib conformation diminishes strain in parts of the housing adjacent the fibs.

25. The connector of claim 20 wherein the gap has a dimension less than a width of the pin between the bottom of said opposing grooves, wherein the apexes of the ribs deform against the bottom of the grooves.

26. The connector of claim 25 wherein the groove profiles are curved, and the ribs engage the pin in an interference fit.

27. The connector of claim 26 wherein the rib profiles are curved, and the rib tips engage the pin in an interference fit.

28. The connector of claim 20 wherein each one of said apertures include an elongate portion extending approximately perpendicular to a plane defined by the centerlines of the corresponding fibs.

29. The connector of claim 28 further comprising plural contact beams disposed at least partly in said aperture elongate portions, each one of said contact beams being in contact with a corresponding pin.

30. The connector of claim 29 further comprising at least one shield disposed along a row of pins, the shield being coupled to the contact beams.

31. The connector of claim 30 wherein the housing includes a pocket disposed on an upper side thereof, said shield being at least partly disposed in said housing.

32. A ball grid array connector comprising:

an anay of pins disposed in the anay of apertures, the apertures defining aperture axes that are parallel to the direction of insertion of the pins, each one of the pins including opposing longitudinal grooves formed therein that are parallel to the aperture axis;

a housing having an upper side, an underside, and the array of apertures, at least a portion of the apertures including an elongate portion that opens onto the upper side of the housing, each one of the apertures including a gap at least partly defined by a pair of opposing ribs, the transverse cross sectional profile of the ribs being adapted to change in response to insertion of the pin into its corresponding aperture to secure the pin;

an array of solder balls disposed on the housing underside proximate ends of said pins; and a plurality of contact beams disposed at least partly in the elongate portions of the apertures such that said contact beams are insertable into the aperture from the upper side of the housing.

33. The ball grid array connector of claim 32 further comprising a slot that opens onto an upper surface of the housing and a shielding bar disposed in said slot, said shielding bar being in contact with at least a portion of said contact beams.

34. The connector of claim 32 wherein the rib is formed of amaterial comprising a plastic.

35. The connector of claim 32 wherein the housing and rib are integrally formed.

36. The ball grid array connector of claim 32 wherein the fibs in an as-molded state have a cross-sectional profile different from a cross-sectional profile of the corresponding pin groove, wherein upon insertion of the pin into said pin aperture the profile of the fibs conforms to match at least a portion of groove profile.

37. The connector of claim 36 wherein the groove profile is curved in transverse cross section, and the rib engages the pin in an interference fit.

38. The connector of claim 37 wherein the rib profile is curved, and the rib tip engages the pin in an interference fit.

39. The connector of claim 37 wherein the rib profile is curved and the rib tip engages the pin groove in an interference fit.

* * * * *

UNITED STATES PATENT AND TRADEMARK OFFICE

CERTIFICATE OF CORRECTION

PATENT NO. : 7,371,131 B2
APPLICATION NO. : 11/098048
DATED : May 13, 2008
INVENTOR(S) : Timothy W. Houtz It is certified that error appears in the above-identified patent and that said Letters Patent is hereby corrected as shown below:

Col. 7, lines 12, 13, 26, delete “fib” and substitute therefor --rib--

Col. 7, lines 22, 31, 43, delete “fibs” and substitute therefor --ribs--

Col. 8, line 31 delete “amaterial” and substitute therefor --a material--

Col. 8, lines 35 and 38, delete “fibs” and substitute therefor --ribs--

Signed and Sealed this

Twenty-second Day of July, 2008

JON W. DUDAS
*Director of the United States Patent and Trademark Office*